US008079533B2

(12) United States Patent
Bowen

(10) Patent No.: US 8,079,533 B2
(45) Date of Patent: Dec. 20, 2011

(54) ROTATING SPRAY NOZZLE AND METHOD OF MANUFACTURING THE SAME

(75) Inventor: Derek Bowen, Mississauga (CA)

(73) Assignee: BEX Engineering, Ltd., Mississagua, Ontario (CA)

( * ) Notice: Subject to any disclaimer, the term of this patent is extended or adjusted under 35 U.S.C. 154(b) by 293 days.

(21) Appl. No.: 12/390,796

(22) Filed: Feb. 23, 2009

(65) Prior Publication Data

US 2010/0213277 A1 Aug. 26, 2010

(51) Int. Cl.
*A62C 37/20* (2006.01)

(52) U.S. Cl. ..... 239/261; 239/237

(58) Field of Classification Search ..... 239/261, 239/225.1, 230, 237, 240, 263, DIG. 14
See application file for complete search history.

(56) References Cited

U.S. PATENT DOCUMENTS

| | | | | |
|---|---|---|---|---|
| 2,194,095 | A | 3/1940 | Noss | |
| 2,531,923 | A | 11/1950 | Smith | |
| 2,670,993 | A | 3/1954 | Nordenstam | |
| 3,125,297 | A | 3/1964 | Copeland et al. | |
| 3,610,532 | A * | 10/1971 | Modrey | 239/251 |
| 3,979,066 | A | 9/1976 | Fortner | |
| 5,096,122 | A | 3/1992 | Abramoska | |
| 5,104,044 | A * | 4/1992 | Ratell, Jr. | 239/240 |
| 5,316,218 | A | 5/1994 | Bowen | |
| 5,326,218 | A | 7/1994 | Fallas | |
| 5,505,380 | A * | 4/1996 | Jun | 239/211 |
| 5,918,813 | A | 7/1999 | Rucker | |
| 6,250,566 | B1 * | 6/2001 | Jager | 239/237 |
| 6,729,559 | B2 * | 5/2004 | Zanma et al. | 239/225.1 |
| 6,736,333 | B2 | 5/2004 | Binder et al. | |
| 6,783,083 | B1 * | 8/2004 | Barker | 239/237 |
| 7,384,005 | B1 | 6/2008 | Caine et al. | |
| 2006/0226257 | A1 | 10/2006 | Lee | |

FOREIGN PATENT DOCUMENTS

| | | |
|---|---|---|
| DE | 20317079 | 1/2004 |
| EP | 0745437 | 12/1996 |

* cited by examiner

*Primary Examiner* — Davis Hwu
(74) *Attorney, Agent, or Firm* — Butzel Long

(57) ABSTRACT

A rotating spray nozzle, comprising an elongate stem securable to a liquid-supply pipe, the stem defining a passageway therethrough for communicating a liquid from the supply pipe, the passageway communicating at least one inlet opening and at least one outlet opening defined in the stem; and a polymer nozzle body freely rotatably mounted on the stem for rotation about a nozzle axis, the nozzle body having an internal cavity in communication with the at least one outlet opening of the stem, and at least one nozzle defined through the nozzle body and communicating with the internal cavity, the at least one nozzle being offset from the nozzle axis to impart a driving couple to the nozzle body to cause rotation thereof when a liquid from the supply pipe is communicated through the at least one nozzle. The stem defines a longitudinal portion bounded at opposite ends thereof by integral annular shoulders having diameters greater than the longitudinal portion. The polymer nozzle body is comprised of two or more separate, mateable portions which are secured together about the stem so that the nozzle body is rotatably captured on the longitudinal portion of the stem between the greater diameter annular shoulders.

18 Claims, 4 Drawing Sheets

ROTATING SPRAY NOZZLE AND METHOD OF MANUFACTURING THE SAME

FIELD OF THE INVENTION

This invention relates to spray nozzles and, more particularly, a rotating spray nozzle, and method of manufacturing the same, wherein two or more separate, mateable portions comprising a polymer nozzle body are secured together about a stem so that the nozzle body is rotatably captured on a longitudinal portion of the stem between greater diameter annular shoulders thereof.

BACKGROUND OF THE INVENTION

Spray nozzles are utilized in many areas where a spray of fluid is required, for example: tank and drum washing; metal washing; foam control; asphalt spraying; vehicle washing; and dish washing. For tank and drum washing, one of the more popular forms of spray nozzles is the self-excited or self-driven rotating spray nozzle assembly. Such a nozzle assembly is secured to an end of a supply pipe and the device is inserted into the vessel to be cleaned either by means of entryways specifically designed for the purpose of cleaning the vessel, or by utilizing existing vessel entryways. The nozzle assembly comprises a fixed or stationary stem for mounting to the supply pipe, and a rotating nozzle body. A bore or passageway extends through the stationary mounting element to outlets that feed the rotating nozzle body rotatably mounted on an outlet end of the stem. Rotating spray nozzle assemblies generally have spray outlets, or outlet orifices, that are provided in pairs opposite one another and at an angle to the axis of rotation. This provides driving forces to rotate the nozzle body. The rotation is intended to distribute the spray over a specific area within the vessel to be cleaned. This area may include a portion, or the complete interior, of the vessel to be cleaned. Exemplary of such rotating spray nozzles is the disclosure of the present inventor's prior U.S. Pat. No. 5,316,218.

As exemplified in the aforesaid U.S. Pat. No. 5,326,218, rotating spray nozzles are characterized by multi-part construction, with the nozzle body being captured on the stem by means of a separate screw threadingly engaging a correspondingly threaded bore provided in the stem. Furthermore, a conical washer is provided, either integral with the screw or as a separate element therefrom. In a second embodiment disclosed in that patent, a retaining clip is provided. The clip has a head, a bifurcated shaft and angled engagement surfaces. The angled engagement surfaces are resiliently pressed inwards during insertion of the retaining clip into a bore provided through the stem and, when fully inserted, they spring outwards to engage shoulders inside the stem.

SUMMARY OF THE INVENTION

According to the specification, there is disclosed a rotating spray nozzle, comprising an elongate stem securable to a liquid-supply pipe, the stem defining a passageway therethrough for communicating a liquid from the supply pipe, the passageway communicating at least one inlet opening and at least one outlet opening defined in the stem, and a nozzle body freely rotatably mounted on the stem for rotation about a nozzle axis, the nozzle body having an internal cavity in communication with the at least one outlet opening of the stem, and at least one outlet orifice defined through the nozzle body and communicating with the internal cavity, the at least one outlet orifice being offset from the nozzle axis to impart a driving couple to the nozzle body to cause rotation thereof when a liquid from the supply pipe is communicated through the at least one outlet orifice. The elongate stem defines a longitudinal portion bounded at opposite ends thereof by integral annular shoulders having diameters greater than the longitudinal portion, and wherein further the nozzle body is comprised of two or more separate, mateable portions which are secured together about the stem so that the nozzle body is rotatably captured on the longitudinal portion of the stem between the greater diameter annular shoulders.

Per one embodiment of the invention, the nozzle body may be a polymer nozzle body. Further to this embodiment, the polymer nozzle body portions may be secured together about the stem by ultrasonic welding.

According to one feature of the invention, the stem may be made of metal or polymer.

According to another inventive feature, the stem may, irrespective of the material from which the nozzle is formed, be of monolithic construction.

The stem may, per yet another feature, comprise a threaded base portion for threaded securement to a supply pipe. However, other conventional means for connecting the stem to a supply source, such as a supply pipe, may alternatively be employed, such conventional means including, without limitation, a sanitary connection, a hose barb, etc.

In one form thereof, the nozzle body, whether made from metal, plastic, etc., consists of two separate, mateable portions that are secured together about the stem. Each such separate portion of the nozzle body may, according to one embodiment, define a portion of the internal cavity. Further to this embodiment, the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body. Further to the foregoing, the nozzle body may have a generally spheroidal shape, with generally flat end surfaces oriented perpendicular to the nozzle axis, the internal cavity has a corresponding spheroidal shape, and wherein each separate portion of the nozzle body is semi-spheroidal in shape.

In addition to the spray nozzle as herein described, the present disclosure further comprehends a method of manufacturing such a rotating spray nozzle, comprising the steps of: (1) Providing an elongate stem securable to a liquid-supply pipe, the stem defining a passageway therethrough for communicating a liquid from the supply pipe, the passageway communicating at least one inlet opening and at least one outlet opening defined in the stem, and the elongate stem further defining a longitudinal portion bounded at opposite ends thereof by integral annular shoulders having diameters greater than the longitudinal portion; (2) providing two or more separate portions which are mateable to define a nozzle body having an internal cavity in communication with the at least one outlet opening of the stem, and at least one outlet orifice defined through the nozzle body and communicating with the internal cavity, the at least one outlet orifice oriented so as to impart a driving couple to the nozzle body to cause rotation thereof when a liquid from the supply pipe is communicated through the at least one outlet orifice; and (3) securing the two or more separate, mateable portions together about the longitudinal portion of the stem between the greater diameter annular shoulders to thereby define an unitary nozzle body freely rotatably captured on the stem between the annular shoulders.

Per one embodiment of this inventive method, the two or more separate, mateable portions may each polymeric. According to this embodiment, the step of securing the two or more separate polymer portions together may comprise securing the polymer portions together via ultrasonic welding.

According to one feature of the invention, the stem may be made of metal or polymer.

According to another inventive feature, the stem may, irrespective of the material from which the nozzle is formed, be of monolithic construction.

The stem may, per yet another feature, comprise a threaded base portion for threaded securement to a supply pipe. However, other conventional means for connecting the stem to a supply source, such as a supply pipe, may alternatively be employed, such conventional means including, without limitation, a sanitary connection, a hose barb, etc.

In one form thereof, the nozzle body, whether made from metal, plastic, etc., consists of two separate, mateable portions that are secured together about the stem. Each such separate portion of the nozzle body may, according to one embodiment, define a portion of the internal cavity. Further to this embodiment, the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body. Further to the foregoing, the nozzle body may have a generally spheroidal shape, with generally flat end surfaces oriented perpendicular to the nozzle axis, the internal cavity has a corresponding spheroidal shape, and wherein each separate portion of the nozzle body is semi-spheroidal in shape.

BRIEF DESCRIPTION OF THE DRAWINGS

For a better understanding of the present invention and to show more clearly how it may be carried into effect, reference will now be made, by way of example, to the accompanying drawings, which show an exemplary embodiment of the present invention, and in which.

DESCRIPTION OF ILLUSTRATED EMBODIMENT

Figure 1:
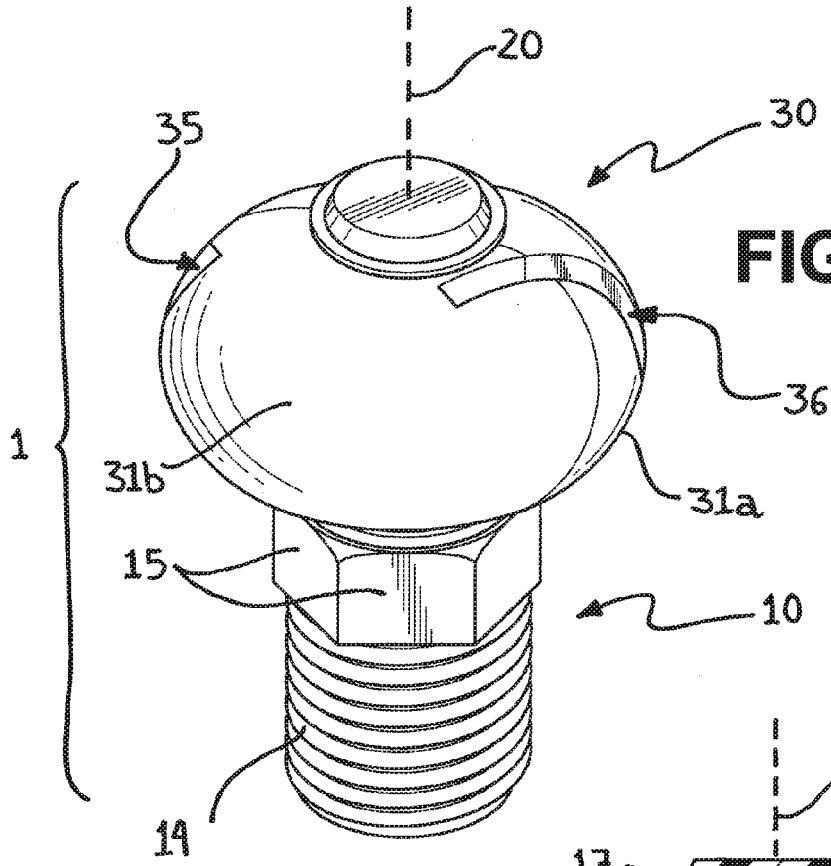
FIG. 1 is a perspective view of a first embodiment of a rotating spray nozzle according to the present invention, mounted on a pipe.
Figure 2:
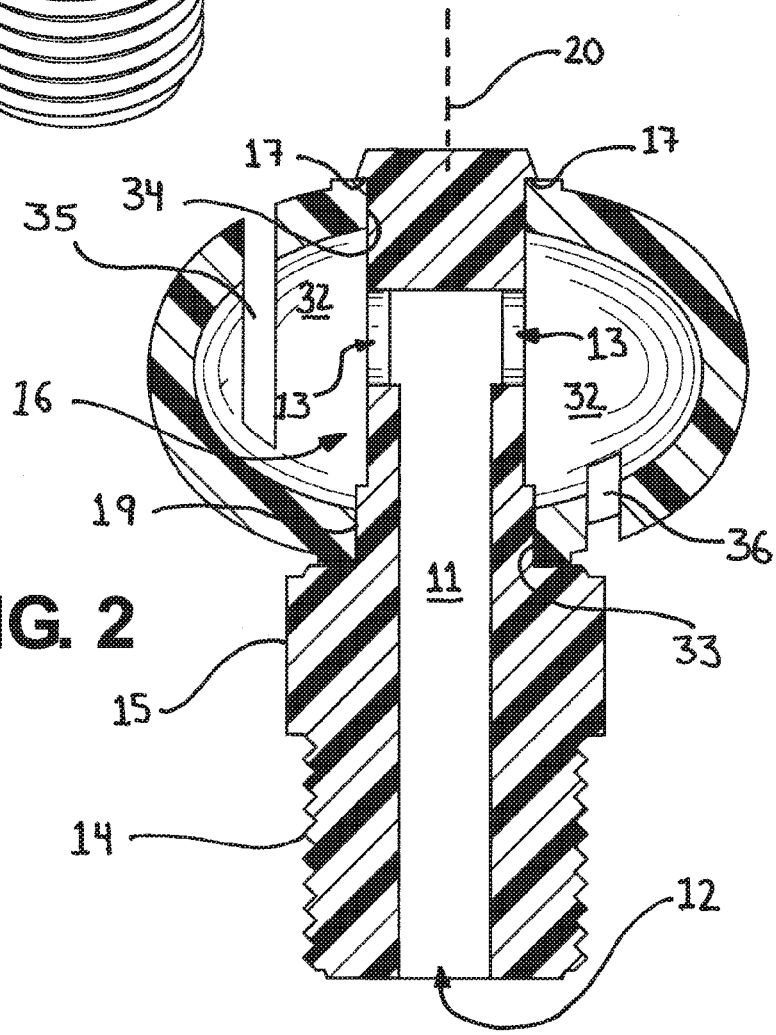
FIG. 2 is a cross-sectional view of the spray nozzle of FIG. 1.
Figure 3:
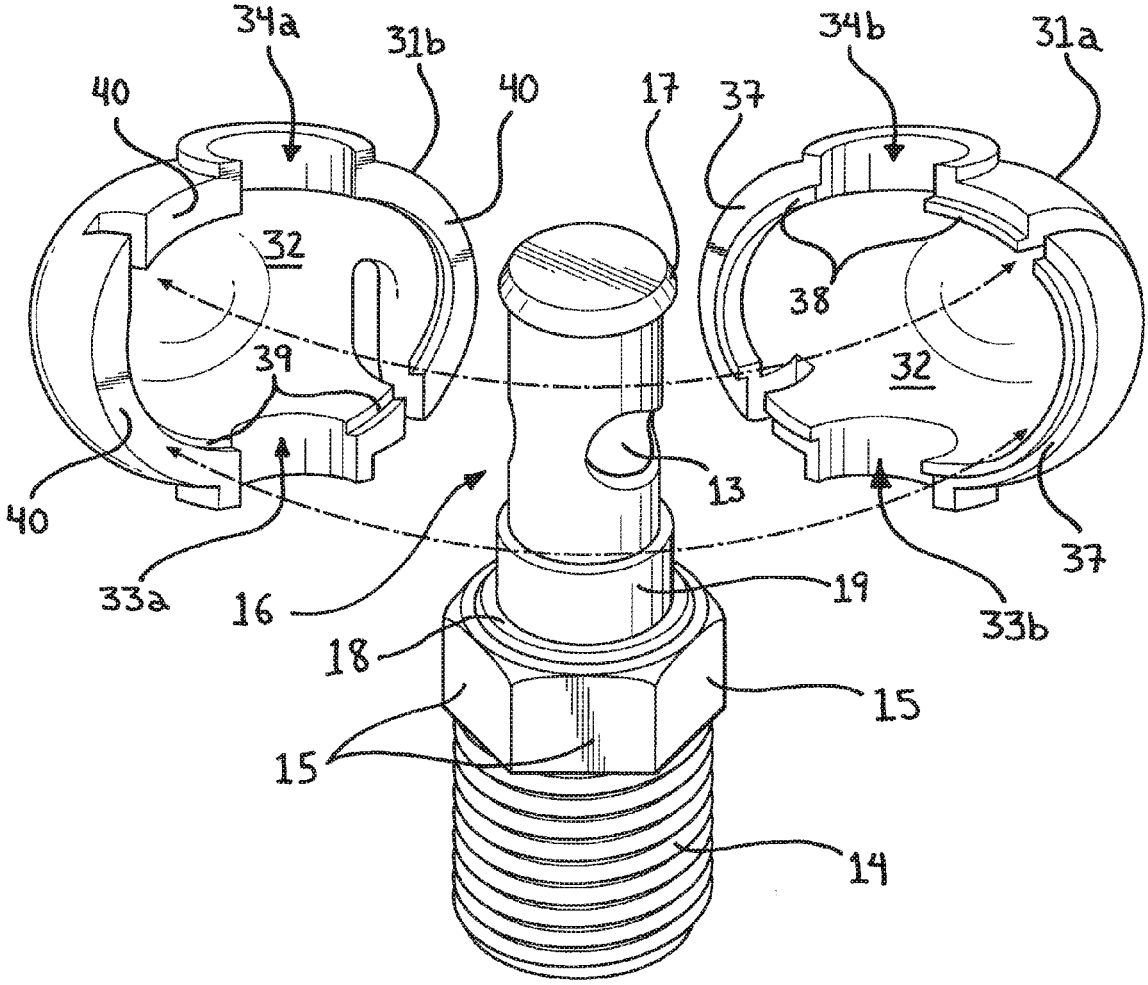
FIG. 3 is an exploded perspective view of the spray nozzle of FIG. 1.

As required, a detailed embodiment of the present invention is disclosed herein. However, it is to be understood that the disclosed embodiment is merely exemplary of the invention that may be embodied in various and alternative forms. The accompanying drawings are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Referring now to the drawings, wherein like numerals refer to like or corresponding parts throughput the several views, the present invention is generally characterized as a rotating spray nozzle (indicated generally at 1) comprising a stem (indicated generally at 10) securable to a liquid-supply pipe (not shown), and a nozzle body (indicated generally at 30) rotatably mounted on the stem 10 for rotation about a nozzle axis 20, the nozzle body including at least one outlet orifice defined through the nozzle body and receiving liquid from the liquid-supply pipe, the at least one outlet orifice being offset from the nozzle axis to impart a driving couple to the nozzle body to cause rotation thereof when a liquid from the supply pipe is communicated through the at least one outlet orifice.

Stem 10 has, according to the illustrated embodiment, a base portion 14 provided with an external screw thread for attachment to corresponding internal threads of the supply pipe. However, internal threads, such as shown in U.S. Pat. No. 5,326,218, the disclosure of which is incorporated herein by reference, may be provided instead where the supply pipe is externally threaded. Still further, any of a variety of other conventional means for securing stem 10 to a supply pipe may be adapted to the stem 10 of this invention. Thus, for instance (and without limitation), the stem may comprise a sanitary connection, a hose barb, etc.

In known manner, stem 10 may also be provided with flat surfaces 15 for engagement of a wrench for secure engagement with the supply pipe.

The stem 10 defines along its principal length a longitudinal portion 16. Longitudinal portion 16 is bounded at opposite ends by integral annular shoulders 17, 18 of the stem having diameters greater than the diameter of the longitudinal portion. As described in more detail below, the nozzle body 30 is captured on the longitudinal portion 16 of the stem 10 between the greater-diameter shoulders 17, 18 in the assembled spray nozzle. Preferably, a lower section 19 of the longitudinal portion 16 proximate the threaded end defines a bearing surface characterized by a diameter greater than that of the rest of the longitudinal portion but smaller than that of either annular shoulder 17, 18.

The stem 10 defines a passageway 11 therethrough for communicating a liquid from the supply pipe, the passageway 11 communicating at least one inlet opening 12 and at least one outlet opening 13. As shown, inlet opening 12 is disposed proximate the threaded end, while a pair of outlet openings 13 are provided, each disposed along the length of longitudinal portion 16.

The assembled nozzle body 30 has a generally spheroid shape and, in the illustrated embodiment, comprises two or more separate, mateable portions 31*a*, 31*b* of generally semi-spheroid configuration that are secured together about the stem 10 in the manner hereinafter described. Nozzle body 30 has an internal cavity 32 in communication with the at least one and, as shown, two outlet openings 13 of the stem 10, the internal cavity generally conforming to the overall shape of the nozzle body 30. Each separate portion 31*a*, 31*b* defines a portion of the internal cavity 32.

A pair of opposed, coaxial openings 33, 34 communicate with the internal cavity 32, the coaxial openings dimensioned to receive the longitudinal portion 16 of the stem therethrough. Each opening 33, 34 is of sufficiently larger diameter than the longitudinal portion 16 so that free rotation of nozzle body 30 about the stem 10 is possible. According to the exemplary embodiment of the drawings, the diameters of coaxial openings 33, 34 further correspond, respectively, to the diameter of the bearing surface 19 and the diameter of the smaller-diameter section of longitudinal portion 16. Also according to the illustrated embodiment, wherein nozzle 30 comprises two separate portions 31*a*, 31*b*, the openings 33, 34 are each defined by a pair of semi-circular cut-outs 33*a*, 33*b*, 34*a*, 34*b*, as shown, one of each pair of cut-outs being defined in each of the separate portions 31*a*, 31*b*.

As shown, nozzle body 30 includes two outlet orifices 35, 36 which are offset from the nozzle axis 20 to impart a driving couple to the nozzle body to cause rotation thereof when a liquid from the supply pipe is communicated through the two or more outlet orifices. Outlet orifices 35, 36 in the nozzle body 30 are, in the illustrated embodiment, slot-shaped openings disposed generally oppositely each other, and are further oriented generally tangential with the internal cavity 32 of the nozzle body. Each slot-shaped outlet orifice 35, 36 is generally planar and of uniform width, though other configurations, known to those skilled in the art, are possible.

In known manner, the outlet orifices 35, 36 are also disposed so as to provide reactionary force on the nozzle body 30 that is offset from its axis 20, the two forces being on the opposite sides of the axis, to develop a couple or moment causing the body 30 to rotate about the axis 20.

Of course, the foregoing construction of nozzle body 30 in respect of the type and disposition of outlet orifices is not intended to be limiting of the present invention, according to which any of a variety of outlet orifice types and arrangements, all known to those skilled in the art for use in conjunction with rotating spray nozzles, may be adopted. For instance, the depth of the outlet orifices 35, 36 will determine the angular coverage of the fan spray produced. This can be adjusted as desired.

Optionally, and as disclosed in U.S. Pat. No. 5,326,218, which disclosure is hereby incorporated herein by reference in its entirety, each outlet orifice 35, 36 may also be designed to ensure that its spray pattern intersects the nozzle axis 20.

With regard to materials for the rotating spray nozzle 1, the stem 10 and nozzle body 30 may each be fabricated from any suitable materials, including metals (e.g., stainless steel) or plastics (such as PVDF or polypropylene). In general, the materials should not be corroded or attacked by materials to which they will be subjected in use. Preferably, though not necessarily, the stem 10 is of monolithic construction. Preferably, though again not necessarily, the stem 10 and nozzle body 30 are both fabricated from plastic and, according to the exemplary embodiment, PVDF more specifically.

In assembly, the two or more separate portions 31*a*, 31*b* of the nozzle body 30 are positioned about the longitudinal portion 16 of stem 10 in the proper orientation; more particularly, so that the semi-circular cut-outs 33*a*, 33*b* are disposed about the larger-diameter bearing surface 19 of the longitudinal portion and the semi-circular cut-outs 34*a*, 34*b* are disposed about the smaller-diameter section of the longitudinal portion 16. Once so positioned, the separate portions 31*a*, 31*b* are secured together so as to define the unitary nozzle body 30. It will be appreciated from this disclosure that when the separate portions 31*a*, 31*b* are secured together, the nozzle body 30 is necessarily captured on the longitudinal portion 16 of stem 10 by reason of the fact that the annular shoulders 17, 18 are of greater diameters than either of the opposed coaxial openings 33, 34 of the nozzle body.

To permit the provisional mating of the separate portions 31*a*, 31*b* of the nozzle body 30, one or both portions 31*a*, 31*b* may be provided with complementary projections and recesses which cooperate in a friction-fit relation to hold the separate portions 31*a*, 31*b* together pending securement as described below. According to the illustrated embodiment more particularly, these complementary projections and recesses take the form of a plurality of ribs 38 projecting outwardly from a mating face 37 of portion 31*a*, and a plurality of corresponding recessed grooves 39 formed in the mating face 40 of portion 31*b*. Grooves 39 are each characterized by a width and depth approximately the same the width and height of ribs 38.

Ribs 38 are, as shown, characterized by a thickness less than the thickness of mating face 37. Further according to the illustrated embodiment, ribs 38 are formed proximate the edge of mating face 38 closest to the internal cavity 32, such that the interiory-facing surface 39 of each rib is coplanar with the interior surface defining the internal cavity 32. Correspondingly, each groove 39 is formed in the edge of the mating face 40 proximate the internal cavity 32 so as to define a step or shoulder between the interior surface defining the interior cavity and the mating face. According to the thus-described arrangement, it will be understood that when provisionally mated by insertion of ribs into their corresponding grooves, the interior surface defining interior cavity 32 will be substantially smooth.

Of course, other means may be employed to provisionally mate the separate portions of nozzle body together, including, for instance, other forms of complementary projections and recesses such as pins receivable in correspondingly-shaped bores. It will also be understood that the above-described and other forms of complementary projections and recesses need not be exclusively disposed on one or the other of the portions 31*a*, 31*b*. Rather, each portion may include both projections and recesses, these being complementary to corresponding recesses and projections disposed on the other portion.

While other means, including adhesives, may be employed to secure the portions 31*a*, 31*b* together, it is preferred, where the nozzle body 30 is formed from polymer, to employ ultrasonic welding. As is known, ultrasonic welding employs the local application of high-frequency ultrasonic acoustic vibrations to parts held together under pressure to create a solid-state weld. More particularly, the parts are sandwiched between a fixed, shaped-nest (anvil) and a sonotrode (horn) connected to a transducer, and a low-amplitude acoustic vibration is emitted. Common frequencies used in ultrasonic welding of thermoplastics are 15 kHz, 20 kHz, 30 kHz, 35 kHz, 40 kHz and 70 kHz. According to the illustrated embodiment, the preferred frequency for the polymer material, PVDF, of the illustrated embodiment is 20 kHz. The ultrasonic energy melts the point contact between the parts due to absorption of vibration energy along the joint being welded, thereby creating a joint.

Figure 4A:
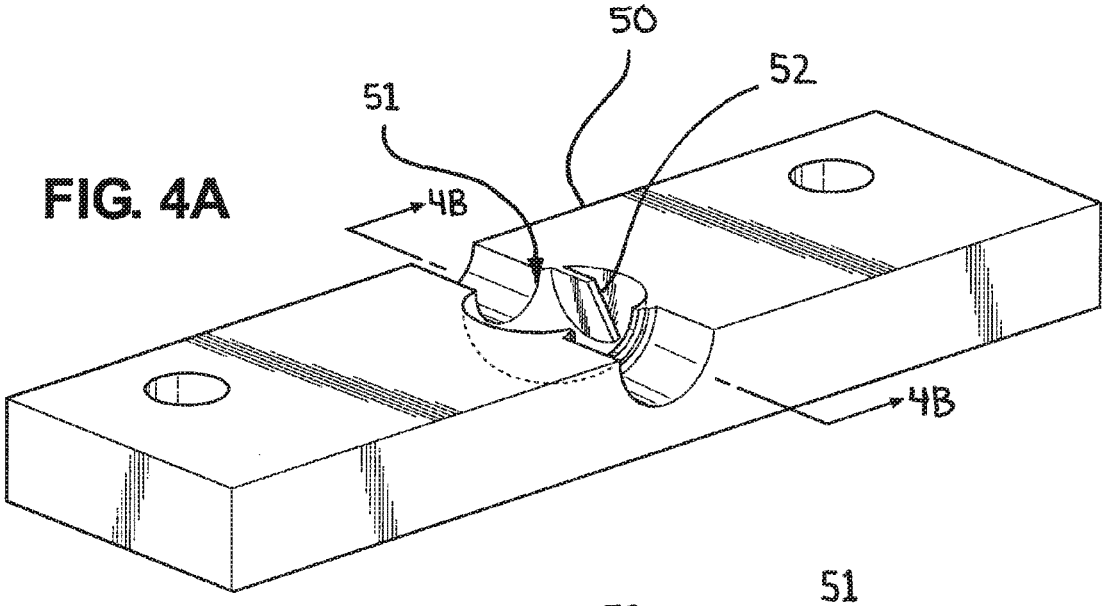
FIG. 4A is a perspective view of a sonic welding nest which may be employed in fabricating the spray nozzle of the invention.
Figure 4B:
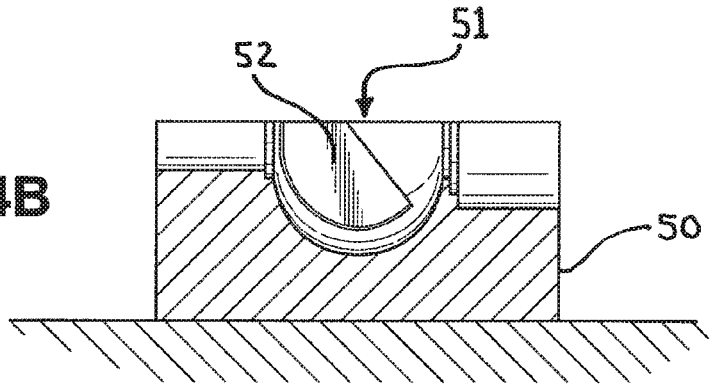
FIG. 4B is a cross-sectional view of the welding nest of FIG. 4A, taken along lines 4B-4B.

Referring more particularly to FIGS. 4A and 4B, the inventive method employs, according to the formation of a spray nozzle of the exemplary embodiment, a welding nest 50 having a cavity 51 defined in an upper surface thereof, the cavity 51 complimentary in shape to a portion of the exterior shape of the spray nozzle so that, as shown, the spray nozzle may be placed in the cavity 51 and a portion of nozzle body 30 will be exposed above the upper surface of the nest. As shown, the longitudinal dimensions of the cavity 51 are such that a portion of the spray nozzle, defined between the upper-end of the stem 10 proximate the shoulder 17 and part-way down the length of the base portion 14 toward the lower end of the stem, is positionable in the cavity 51. As shown, the hemispherically-shaped portion of cavity 51 complimentary in shape to the nozzle body 30 has defined therein an upwardly-projecting flange or rib 52 dimensioned to be received in one of the slot-shaped outlet orifices 35, 36 of the nozzle body of the exemplary embodiment. According to such construction, rib 52 serves to prevent unwanted rotation of the nozzle body 30 within the cavity 51 during the sonic welding process. By the placement of the slot-shaped outlet orifices 35, 36 in the nozzle body 30 of the exemplary embodiment, it will be appreciated that the portions 31*a*, 31*b* of nozzle body are oriented so that the interface between mating faces 37 and 40 is oriented in a plane that is either the same as, or generally parallel to and positioned below, the plane defined by the upper surface of the nest 50.

Figure 5A:
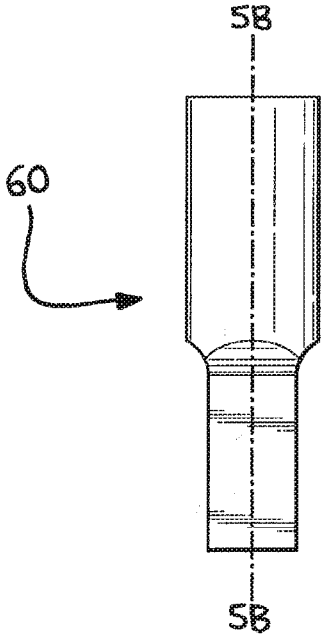
FIG. 5A is a perspective view of a sonic welding horn which may be employed in fabricating the spray nozzle of the invention.
Figure 5B:
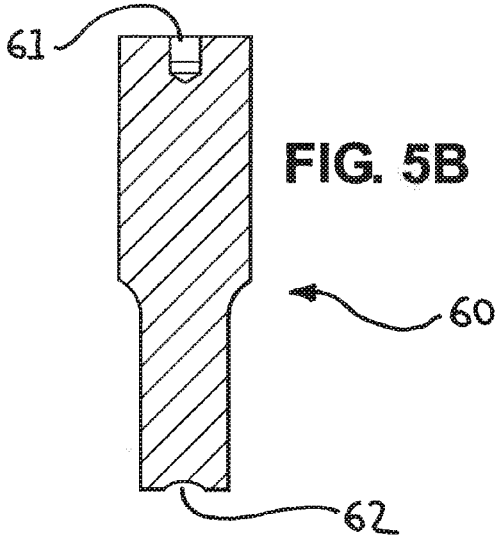
FIG. 5B is a cross-sectional view of the welding horn of FIG. 5A, taken along lines 5B-5B.

Referring next to FIGS. 5A and 5B, the horn 60 comprises a longitudinally-extending element having a first, upper end defining an attachment point 61 for connection to a transducer, and an opposite, lower end defining a contact surface with a cut-out 62 for receiving a portion of the nozzle body 30 therein. More particularly, the cut-out 62 defines a convex shape the dimensions of which are complimentary to the shape of the exterior surface of the nozzle body 30 so that the cut-out 62 may be brought into contact with that exterior surface.

Figure 6B:
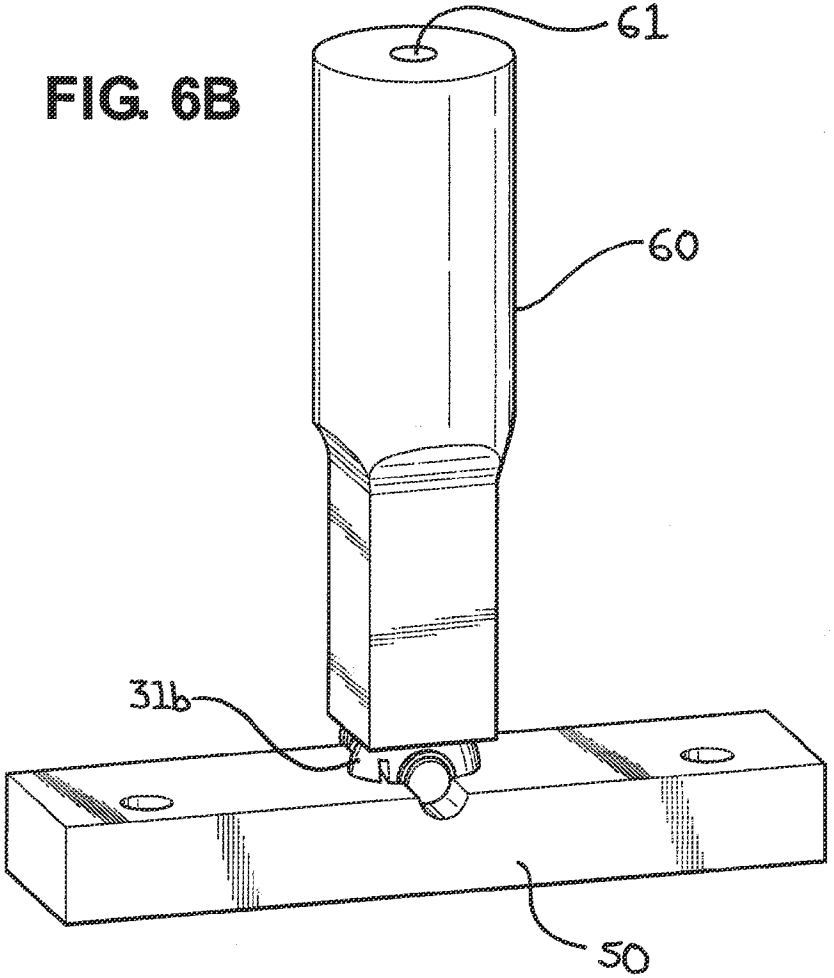
FIG. 6B is a perspective view of the sonic welding nest and horn of FIGS. 4A through 5B, shown in a second condition of employment in welding together the portions of the nozzle body of the inventive spray nozzle.
Figure 6A:
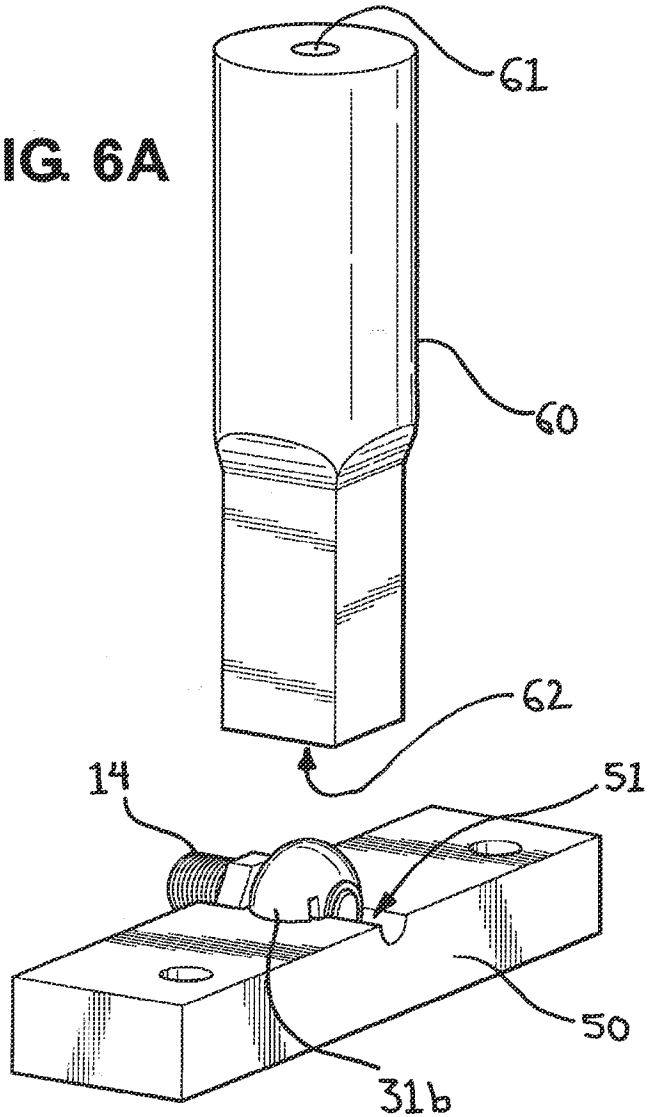
FIG. 6A is a perspective view of the sonic welding nest and horn of FIGS. 4A through 5B, shown in a first condition of employment in welding together the portions of the nozzle body of the inventive spray nozzle.

Referring now to FIGS. 6A and 6B, employment of the foregoing sonic welding apparatus will be better understood. Once the portions 31*a*, 31*b* of nozzle body 30 are provisionally mated about the stem 10, that portion of the thus-assembled spray nozzle defined between the upper-end of the stem 10 proximate the shoulder 17 and part-way down the length of the base portion 14 toward the lower end of the stem is placed into cavity 51 defined in the nest 50 (FIG. 6A). Thereafter, the cut-out 62 of horn 60 is brought into contact with the surface of that of the portions 31*a* or 31*b* remaining exposed above the cavity 51 (FIG. 6B). As shown, the horn 60 is oriented so that it contacts the nozzle body 30 radially in relation to the nozzle axis 20 defined previously. Following receipt of a portion of the nozzle body 30 in the cut-out 62, the low-amplitude vibration is emitted to form a weld between the mating faces 37, 40 of the body portions 31*a*, 31*b* in the manner hereinabove described.

The foregoing description of the exemplary embodiment of the invention has been presented for purposes of illustration and description. It is not intended to be exhaustive or to limit the invention to the precise form disclosed, and modifications and variations are possible in light of the above teachings or may be acquired from practice of the innovation. The embodiment shown and described in order to explain the principals of the innovation and its practical application to enable one skilled in the art to utilize the innovation in various embodiments and with various modifications as are suited to the particular use contemplated. Although only one embodiment of the present innovations have been described in detail in this disclosure, those skilled in the art who review this disclosure will readily appreciate that many modifications are possible without materially departing from the novel teachings and advantages of the subject matter recited. Accordingly, all such modifications are intended to be included within the scope of the present innovations. Other substitutions, modifications, changes and omissions may be made in the design, operating conditions and arrangement of the exemplary embodiments without departing from the spirit of the present innovations.

The invention in which an exclusive property or privilege is claimed is defined as follows:

1. A rotating spray nozzle, comprising:

an elongate stem securable to a liquid-supply pipe, the stem defining a passageway therethrough for communicating a liquid from the supply pipe, the passageway communicating at least one inlet opening and at least one outlet opening defined in the stem; and a nozzle body freely rotatably mounted on the stem for rotation about a nozzle axis, the nozzle body having an internal cavity in communication with the at least one outlet opening of the stem, and at least one outlet orifice defined through the nozzle body and communicating with the internal cavity, the at least one outlet orifice being offset from the nozzle axis to impart a driving couple to the nozzle body to cause rotation thereof when a liquid from the supply pipe is communicated through the at least one outlet orifice, wherein the elongate stem defines a longitudinal portion bounded at opposite ends thereof by integral annular shoulders having diameters greater than the longitudinal portion, and wherein further the nozzle body is comprised of two or more separate, mateable portions which are secured together about the stem so that the nozzle body is rotatably captured on the longitudinal portion of the stem between the greater diameter annular shoulders, such that each separate portion of the nozzle body defines a portion of the internal cavity, and the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body.

2. The rotating spray nozzle of claim 1, wherein the nozzle body has a generally spheroidal shape, with generally flat end surfaces oriented perpendicular to the nozzle axis, the internal cavity has a corresponding spheroidal shape, and wherein each separate portion of the nozzle body is semi-spheroidal in shape.

3. The rotating spray nozzle of claim 1, wherein the nozzle body consists of two separate, mateable portions that are secured together about the stem.

4. The rotating spray nozzle of claim 1, wherein each separate portion of the nozzle body defines a portion of the internal cavity, and wherein the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body.

5. The rotating spray nozzle of claim 1, wherein the nozzle body has a generally spheroidal shape, with generally flat end surfaces oriented perpendicular to the nozzle axis, the internal cavity has a corresponding spheroidal shape, and wherein each separate portion of the nozzle body is semi-spheroidal in shape.

6. A method of manufacturing a rotating spray nozzle, said method comprising the steps of:

providing an elongate stem securable to a liquid-supply pipe, the stem defining a passageway therethrough for communicating a liquid from the supply pipe, the passageway communicating at least one inlet opening and at least one outlet opening defined in the stem, and the elongate stem further defining a longitudinal portion bounded at opposite ends thereof by integral annular shoulders having diameters greater than the longitudinal portion;

providing two or more separate portions which are mateable to define a nozzle body having an internal cavity in communication with the at least one outlet opening of the stem, and at least one outlet orifice defined through the nozzle body and communicating with the internal cavity, the at least one outlet orifice oriented so as to impart a driving couple to the nozzle body to cause rotation thereof when a liquid from the supply pipe is communicated through the at least one outlet orifice; and securing the two or more separate, mateable portions together about the longitudinal portion of the stem between the greater diameter annular shoulders to thereby define an unitary nozzle body freely rotatably captured on the stem between the annular shoulders, wherein each separate portion of the nozzle body defines a portion of the internal cavity, and the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body.

7. The method of claim 6, wherein the two or more separate, mateable portions are each polymeric.

8. The method of claim 6, wherein the step of securing the two or more separate polymer portions together comprises securing the polymer portions to via ultrasonic welding.

9. The method of claim 6, wherein the stem is made of metal.

10. The method of claim 6, wherein the stem is made of polymer.

11. The method of claim 6, wherein the stem is of monolithic construction.

12. The method of claim 6, wherein the stem is of monolithic construction.

13. The method of claim 6, wherein the stem includes a threaded base portion for threaded securement to a supply pipe.

14. The method of claim 6, wherein the nozzle body consists of two separate, mateable portions that are secured together about the stem.

15. The method of claim 6, wherein the nozzle body has a generally spheroidal shape, with generally flat end surfaces oriented perpendicular to the nozzle axis, the internal cavity has a corresponding spheroidal shape, and wherein each separate portion of the nozzle body is semi-spheroidal in shape.

16. The method of claim 6, wherein the nozzle body consists of two separate, mateable portions that are secured together about the stem.

17. The method of claim 6, wherein each separate portion of the nozzle body defines a portion of the internal cavity, and wherein the nozzle body defines a pair of opposed, coaxial openings therethrough for receiving the longitudinal portion of the stem, each of the openings communicating with the internal cavity, and each of the openings of the nozzle body being defined by a pair of semi-circular cut-outs, one of said pair of cut-outs being defined in each of the separate portions of the nozzle body.

18. The method of claim 17, wherein the nozzle body has a generally spheroidal shape, with generally fiat end surfaces oriented perpendicular to the nozzle axis, the internal cavity has a corresponding spheroidal shape, and wherein each separate portion of the nozzle body is semi-spheroidal in shape.

* * * * *